US011484472B2

(12) United States Patent
Asherov et al.

(10) Patent No.: US 11,484,472 B2
(45) Date of Patent: Nov. 1, 2022

(54) FLUID TRANSFER DEVICE

(71) Applicant: Aran Research Development and Prototypes Ltd., Caesarea (IL)

(72) Inventors: Asaf Asherov, Pardes Hana (IL); Dmitry Golom, Haifa (IL); Yaron Cina, Sharona (IL); Avraham Zakay, Tel Aviv (IL)

(73) Assignee: Aran Research Development and Prototypes Ltd., Caesarea (IL)

( * ) Notice: Subject to any disclaimer, the term of this patent is extended or adjusted under 35 U.S.C. 154(b) by 0 days.

(21) Appl. No.: 16/763,659

(22) PCT Filed: Nov. 13, 2018

(86) PCT No.: PCT/IB2018/058912

§ 371 (c)(1),
(2) Date: May 13, 2020

(87) PCT Pub. No.: WO2019/092680

PCT Pub. Date: May 16, 2019

(65) Prior Publication Data

US 2020/0268610 A1 Aug. 27, 2020

Related U.S. Application Data

(60) Provisional application No. 62/585,024, filed on Nov. 13, 2017.

(51) Int. Cl.

| | |
|---|---|
| ***A61J 1/22*** | (2006.01) |
| ***B65B 3/00*** | (2006.01) |
| ***B65B 3/28*** | (2006.01) |

(52) U.S. Cl.
CPC ..... *A61J 1/22* (2013.01); *B65B 3/003* (2013.01); *B65B 3/28* (2013.01)

(58) Field of Classification Search
CPC .... A61J 1/20; A61J 1/22; B65B 3/003; B65B 3/26; B65B 3/28
See application file for complete search history.

(56) References Cited

U.S. PATENT DOCUMENTS 3,935,883 A * 2/1976 Stach ..... A61M 5/1782 141/27
5,885,270 A * 3/1999 Ortiz ..... A61J 1/2089 604/403

(Continued)

FOREIGN PATENT DOCUMENTS

WO 2017/096072 6/2017

OTHER PUBLICATIONS

PCT Search Report and Written Opinion PCT/IB2018/058912, dated Mar. 22, 2019.

(Continued)

*Primary Examiner* — Nicolas A Arnett
(74) *Attorney, Agent, or Firm* — David Klein

(57) ABSTRACT

A fluid transfer device (10) includes a vial holder (23) configured to hold a vial (22). An actuator (40) is coupled to the vial holder (23) and can rotate the vial (22) between upright and inverted positions. A pump (positive or negative pressure) can pump contents out of the vial (22). Before pumping of the contents the actuator (40) rotates the vial (22) to the inverted position and after pumping of the contents the actuator (40) rotates the vial (22) to the upright position.

4 Claims, 5 Drawing Sheets

(56) References Cited

U.S. PATENT DOCUMENTS

| | | | | |
|---|---|---|---|---|
| 6,070,761 | A * | 6/2000 | Bloom | A61J 3/002 222/81 |
| 6,790,198 | B1 | 9/2004 | White | |
| 7,398,802 | B2 * | 7/2008 | Baker | A61J 1/2089 141/27 |
| 7,418,981 | B2 * | 9/2008 | Baker | A61J 1/2089 141/104 |
| 7,575,567 | B2 * | 8/2009 | Simpkins | A61M 5/16827 604/86 |
| 8,382,696 | B2 * | 2/2013 | Beiriger | A61M 1/3462 604/6.11 |
| 9,883,987 | B2 * | 2/2018 | Lopez | A61J 1/2089 |
| 10,181,186 | B2 * | 1/2019 | Kriheli | G06K 9/00771 |
| 10,188,849 | B2 * | 1/2019 | Fangrow | A61M 39/24 |
| 2004/0087888 | A1 | 5/2004 | Digianfilippo | |
| 2004/0154690 | A1 | 8/2004 | Osborne | |
| 2008/0169043 | A1 | 7/2008 | Osborne | |
| 2010/0243103 | A1 | 9/2010 | Ono | |
| 2010/0245056 | A1 | 9/2010 | Braun | |
| 2014/0135732 | A1 | 5/2014 | Spronken | |
| 2014/0299221 | A1 | 10/2014 | Lopez et al. | |
| 2016/0206511 | A1 | 7/2016 | Garfield | |
| 2016/0354281 | A1 | 12/2016 | O'Neill | |
| 2017/0172849 | A1 | 6/2017 | Bochenko et al. | |

OTHER PUBLICATIONS

Galil Motion Control "DMC—40×0", Data Sheet, Jun. 16, 2017.
European Patent Application 18876578.8, Search Report, dated Jul. 22, 2021.

* cited by examiner

FLUID TRANSFER DEVICE

FIELD OF THE INVENTION

The present invention relates generally to fluid transfer devices between receptacles, and particularly to a closed-system fluid transfer device that uses pressure to transfer fluid between two receptacles, such as from a vial to a bag or syringe, without any toxic or non-desirable substances leaking to the ambient.

BACKGROUND OF THE INVENTION

When preparing and administering drugs care has be taken to minimize or preferably eliminate the risk of exposing people, such as medical and pharmacological personnel, to toxic substances. Transferring a liquid medicinal substance from a vial to a bag or syringe requires care to keep the substance free of contamination and to ensure that no toxic or non-desirable substances leak to the ambient.

SUMMARY OF THE INVENTION

The present invention seeks to provide a fluid transfer device with a pump, as is described more in detail hereinbelow. In the present invention, the fluid transfer device transfers fluids between two receptacles (e.g., between a vial and a syringe or between a vial and an infusion bag), and the device is sealed at all times to prevent leakage of substances from within the fluid transfer device to the ambient atmosphere.

There is provided in accordance with an embodiment of the invention a vial holder configured to hold a vial, an actuator coupled to the vial holder, the actuator configured to rotate the vial between upright and inverted positions, and a pump configured to pump contents out of the vial, wherein before pumping of the contents the actuator rotates the vial to the inverted position and after pumping of the contents the actuator rotates the vial to the upright position.

There is provided in accordance with an embodiment of the invention a fluid transfer device including a pump and a vial holder, the vial holder including an intermediate chamber in fluid communication with the pump via a fluid connector and a one-way valve, the intermediate chamber being in fluid communication with a vial via a spike or needle configured to puncture a septum of the vial, wherein fluid pressure in the intermediate chamber is greater than fluid pressure in the vial during pumping of contents out of the vial.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
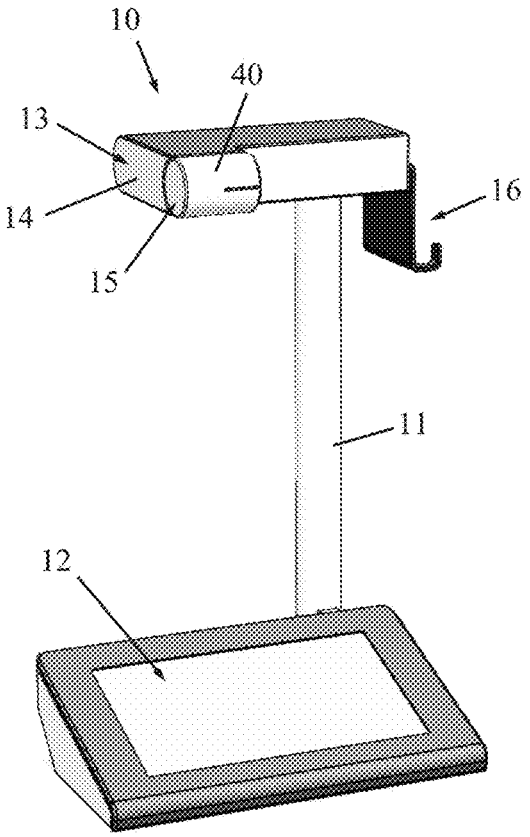
FIG. 1 is a simplified pictorial illustration of a platform for a fluid transfer device, constructed and operative in accordance with a non-limiting embodiment of the present invention.

Reference is now made to FIG. 1, which illustrates a platform for a fluid transfer device 10, constructed and operative in accordance with a non-limiting embodiment of the present invention. The platform includes a vertical stand 11 connected to an operating console 12 with a touchpad for inputting commands and for viewing data, such as weight of vial, pressure of air, fluid velocity of the contents leaving the vial to the bag, etc. The upper end of vertical stand 11 is connected to the fluid transfer device 10, which includes a pump or pressurized air source 13, a scale 14 (e.g., load cell) and a fluid connector 15 for transferring air into the vial holder described below. A hook 16 is provided for hanging a bag thereon. The pump 13 may be a source of positive (pressurized) air for driving fluid out of the vial; however, alternatively, the pump may be a source of negative pressure (suction) for drawing fluid out of the vial.

The pump may be any kind of suitable pump, such as but not limited to, a peristaltic pump, a dosing pump, a reciprocating pump, centrifugal pump, and many others. The pump may be external to the device as well.

Figure 2A:
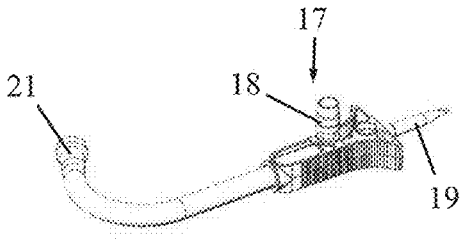
FIG. 2A is a simplified pictorial illustration of a connector assembly for connecting the fluid transfer device to a bag and syringe, in accordance with a non-limiting embodiment of the present invention.
Figure 2B:
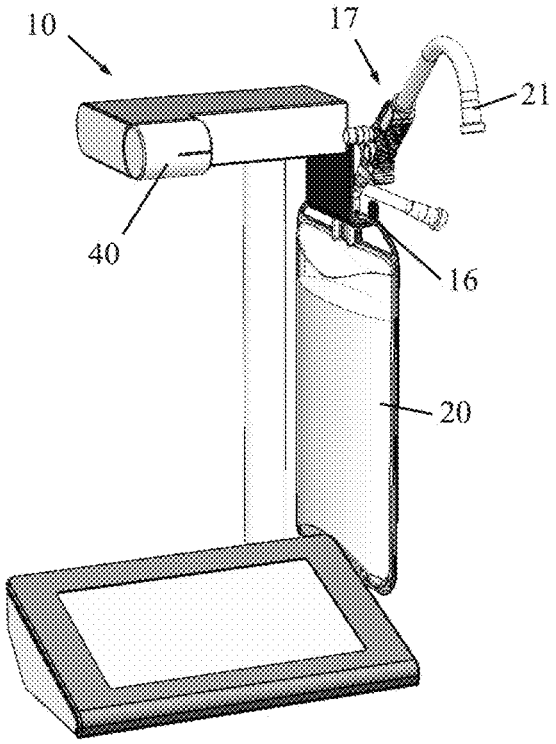
FIG. 2B is a simplified pictorial illustration of the connector assembly of FIG. 2A connected to a bag which is supported by the platform of FIG. 1.

Reference is now made to FIGS. 2A and 2B, which illustrate a connector assembly 17 for connecting the fluid transfer device 10 to a bag and syringe, in accordance with a non-limiting embodiment of the present invention. The connector assembly 17 includes a first port 18 for connecting to a receptacle adaptor (described below with reference to FIGS. 3A and 3B), a second port 19 (such as a spike) for connecting to an infusion bag 20 (FIG. 2B) and a third port 21 for connecting to another receptacle, such as a syringe, or for taking samples and the like.

The fluid transfer device 10 may include an actuator 40, such as a motor (FIG. 2B), for rotating vial 22 between upright and upside down positions. Although this is the preferred embodiment, vial 22 may be alternatively rotated manually between upright and upside down positions.

Figure 3A:
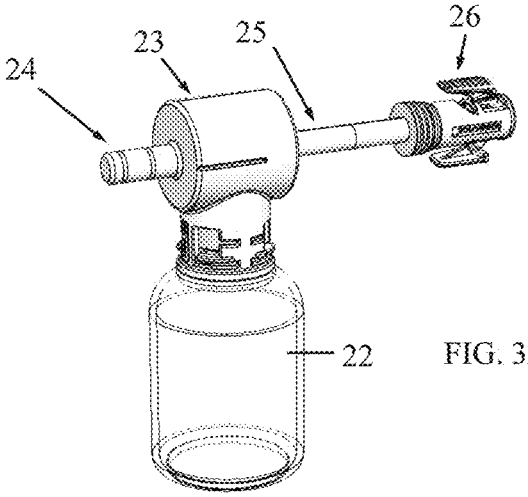
FIG. 3A is a simplified pictorial illustration of a vial connected to a vial holder, the vial holder having a connector to an air source and a tube connected to a receptacle (syringe or bag) adaptor, in accordance with a non-limiting embodiment of the present invention.
Figure 3B:
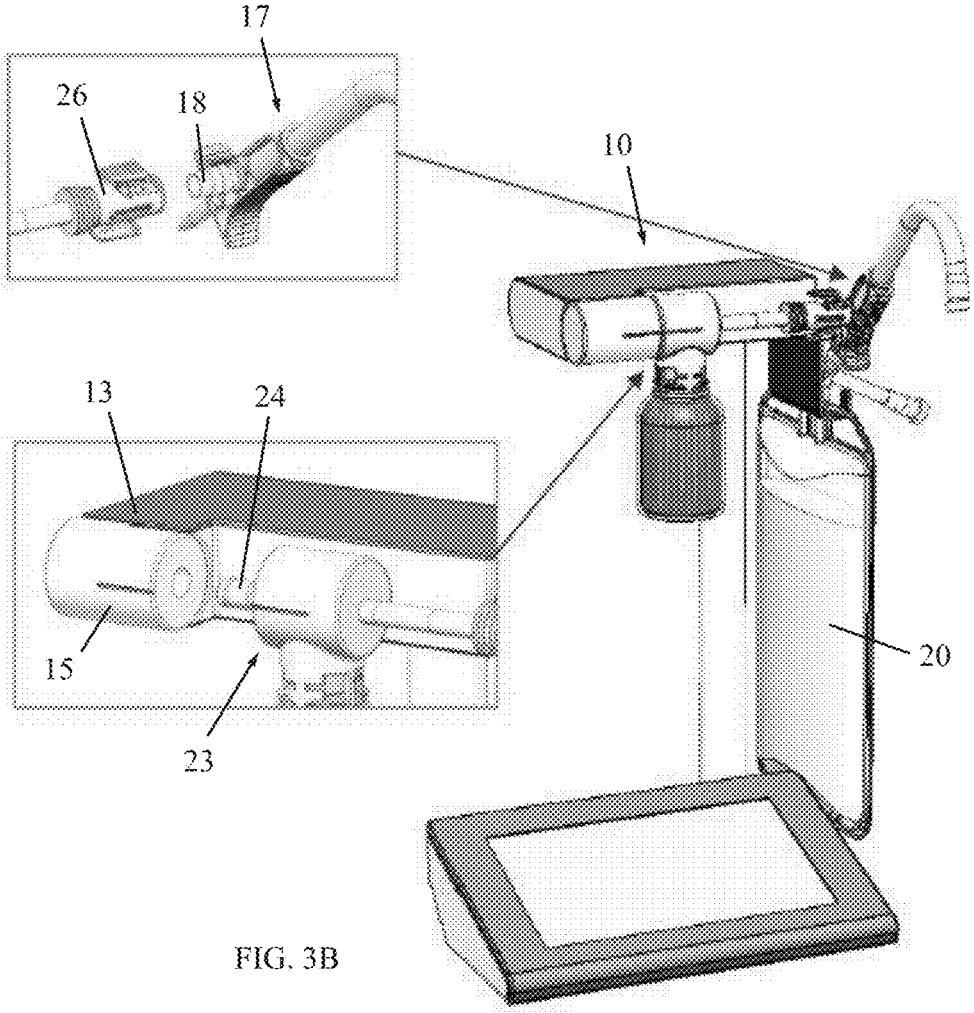
FIG. 3B is a simplified pictorial illustration of the vial holder of FIG. 3A connected to the air source of the platform of FIG. 1 and to the connector assembly of FIG. 2A.

Reference is now made to FIG. 3A, which illustrates a vial 22 connected to a vial holder 23 (which is coupled to the actuator 40). Vial holder 23 includes a connector 24 for connecting to pressurized air source 13, and a tube 25 (e.g., a flexible tube) connected to a receptacle (syringe or bag) adaptor 26. As seen in FIG. 3B, the connector 24 of vial holder 23 may be connected by a quick connect/disconnect connector (or other connector, such as a luer lock) to fluid connector 15 which is in fluid communication with the air source 13. The receptacle adaptor 26 of vial holder 23 may be connected by a quick connect/disconnect connector (or other connector, such as a luer lock) to first port 18 of the connector assembly 17.

Figure 4:
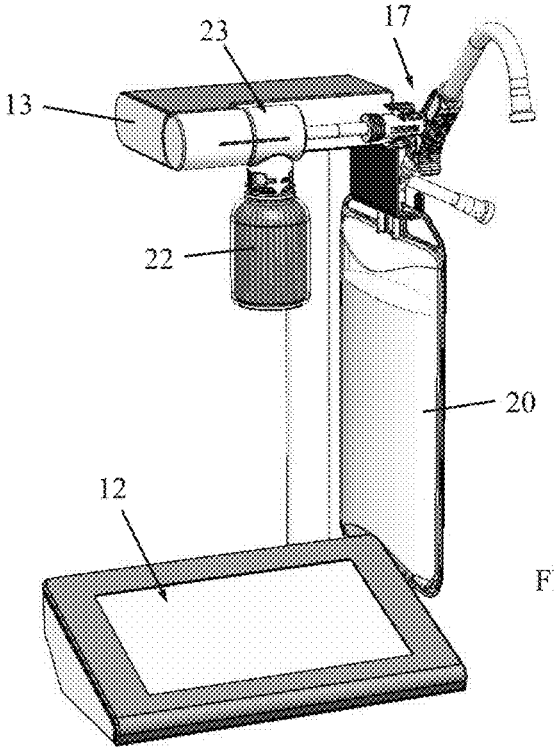
FIG. 4 is another pictorial illustration of the vial holder of FIG. 3A connected to the air source of the platform of FIG. 1 and to the connector assembly of FIG. 2A.

FIG. 4 illustrates the vial holder 23 fully connected to air source 13 and to the connector assembly 17.

Figure 7:
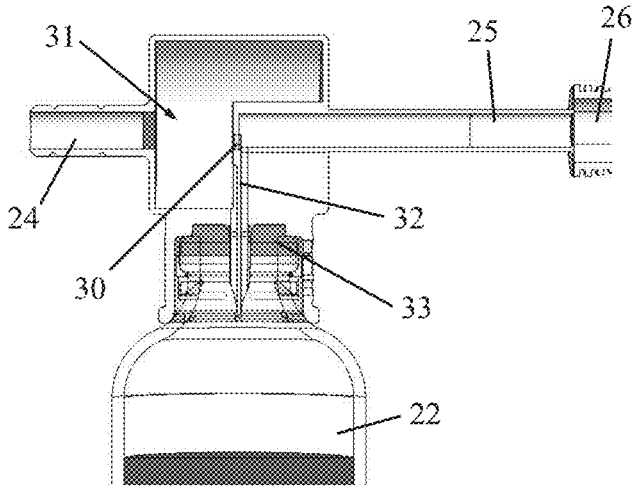
FIG. 7 is a simplified cutaway illustration of the vial holder of FIG. 3A.

Reference is now made to FIG. 7, which illustrates one embodiment of the vial holder 23 of FIG. 3A. The connector 24 of vial holder 23 leads air into an intermediate chamber 31, which is in fluid communication via a one-way valve 30 with a spike or needle 32, which punctures a septum 33 of vial 22. The intermediate chamber 31 is used in vial holder 23 when a positive pressure pump is used; it is not necessary if a negative pressure pump is used to suck contents out of the vial. With a positive pressure pump, the pressure P1 in intermediate chamber 31 is greater than the pressure P2 in vial 22 during pumping of contents out of vial 22. Only after the pumping process is completed is P2=P1. With a negative pressure pump, the pressure downstream of the vial is made lower than the pressure in the vial in order to draw the contents out of the vial.

One of the advantages of the intermediate chamber 31 is now explained. The pressure P2 in vial 22 is greater than atmospheric pressure. This can cause leaking of the fluid out of the vial, which is not only undesirable but can also be dangerous if the fluid is considered toxic. The pressure in the intermediate chamber 31 is greater than the pressure P2 in vial 22 and the intermediate chamber 31 does not contain any toxic material. Consequently, since the pressure in the intermediate chamber 31 is greater than the pressure P2 in vial 22, no fluid can leak out of vial 22.

Figure 5A:
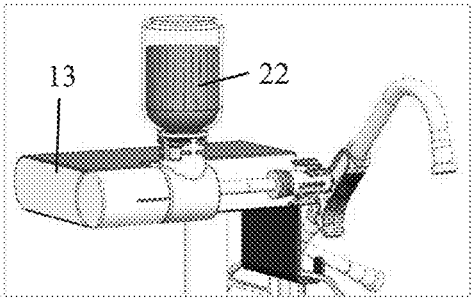
FIGS. 5A, 5B and 5C are simplified pictorial illustrations of using the fluid transfer device, including first turning the vial upside down and weighing the contents (FIG. 5A), using the pump to introduce air into the vial (FIG. 5B) and the pressurized air driving the liquid out of the vial into the bag (FIG. 5C)
Figure 5B:
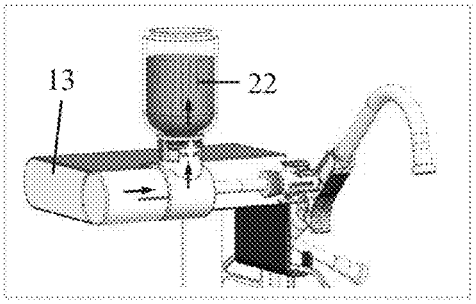
Figure 5C:
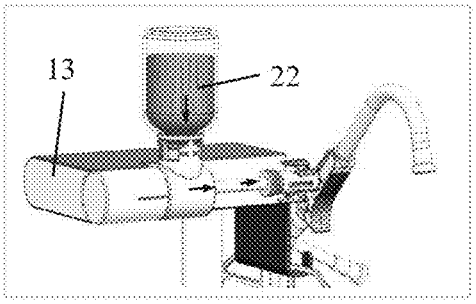

Reference is now made to FIGS. 5A, 5B and 5C, which illustrate using the fluid transfer device. In FIG. 5A, vial 22 is turned upside down and its contents are weighed by scale 14. In FIG. 5B, pump 13 introduces air into vial 22. In FIG. 5C, the pressurized air drives the liquid out of vial 22 towards the bag.

Figure 6:
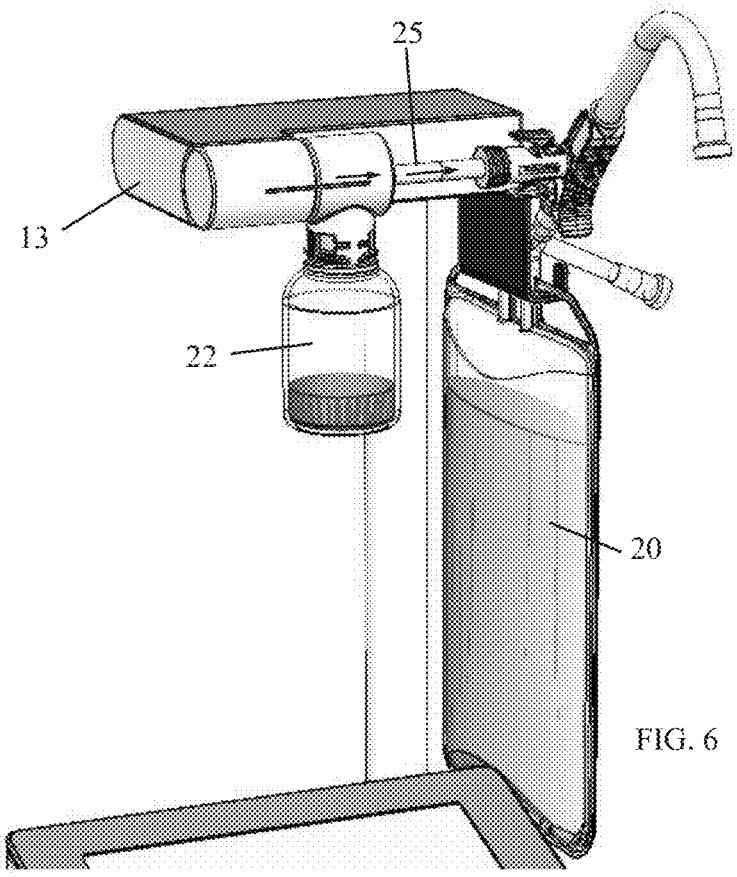
FIG. 6 is a simplified pictorial illustration of further use of the fluid transfer device, in which the vial is turned right side up and the pump introduces pressurized air into the tube to drive any remaining liquid into the bag.

Reference is now made to FIG. 6, which illustrates further use of the fluid transfer device, in which vial 22 is turned right side up and the pump 13 introduces pressurized air into the tube 25 to drive any remaining liquid into the bag 20.

The actuator 40 may automatically rotate the vial from the upside down (inverted) position to the upright position upon the scale sensing that the weight of the vial has been lowered to the desired amount (or upon sensing the volume has reached a desired level). This automatic rotation of the vial provides a quick and accurate closing (and opening) of the vial, without any need for pinch valves and the like which have the disadvantage of slower response and leftover contents in the valve and its connecting elements or tubing. The automatic rotation of the vial may be used to prevent leaking of the fluid out of the vial. Even when application of pressure has ceased to drive fluid out of the vial, residual fluid may still come out of the vial due to the previously increased pressure in the vial. By turning the vial over, no fluid flows out and instead remains in the vial.

The system may use a set of accelerometers and algorithms to detect and neutralize any mechanical impacts and other noises that might undermine the system accuracy.

Figure 8:
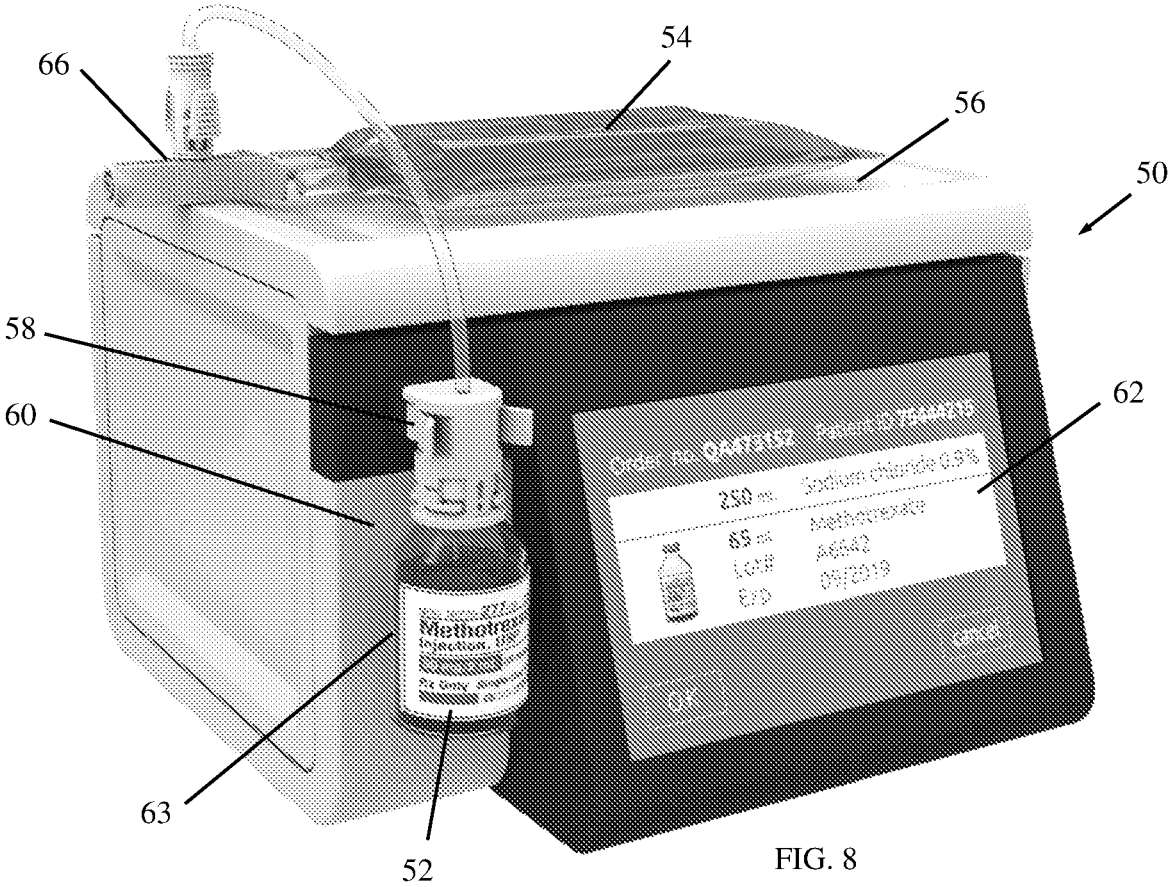
FIG. 8 is a simplified pictorial illustration of a fluid transfer device, constructed and operative in accordance with another non-limiting embodiment of the present invention.

Reference is now made to FIG. 8, which illustrates a fluid transfer device 50, constructed and operative in accordance with another non-limiting embodiment of the present invention.

The fluid transfer device 50 may be used for transferring fluid from a vial 52 to a bag 54. The bag 54 may be supported on a bag weight module 56 (e.g., a load cell), which may provide real-time weight of the bag 54 for continuously monitoring how much fluid is transferred at any time to the bag 54.

The vial 52 is held in a vial holder 58, such as but not limited to, resilient clips that clamp the neck of the vial or any other suitable device for holding the vial in place. An identification module 60, such as but not limited to, a barcode reader, RFID device and the like, may identify the contents of the vial 52 (such as by reading a code 63 on the vial 52) and verify that the contents are the proper contents and that they match the proper substance for a specific patient. The patient may have an identification number or code and a processor 62 compares the contents of the vial 52 as identified by identification module 60 with the patient identification number or code. If and only if the match is authorized, the processor 62 allows the fluid transfer device 50 to transfer fluid from vial 52 to bag 54. Processor 62 thus provides automatic patient prescription analysis.

The vial holder 58 may include a vial weight module 64 (e.g., a load cell), which may provide real-time weight of the vial 52 for continuously monitoring how much fluid is transferred at any time from vial 52.

The fluid transfer device 50 may include a fluid pressure source 66 for effecting transfer of fluid from vial 52 to bag 54. For example, fluid pressure source 66 may be a source of compressed air, so that the fluid is transferred by positive pressure. Alternatively, fluid pressure source 66 may be a suction source, so that the fluid is transferred by negative pressure.

As in the other embodiments, the fluid transfer device 50 is a closed system transfer device (CSTD), which complies with hazardous drug safe handling guidelines. The system is accurate, and can be used for direct draw of fluid from the vial to the bag and can be used for reconstitution. There is no dead volume during the fluid transfer. The device is compact and fits into the smallest hoods used today (for example, about 90 cm wide). The device may be used for multi-vial drug accumulation.

What is claimed is:

1. A fluid transfer device comprising:

a pump and a vial holder, said vial holder comprising an intermediate chamber in fluid communication with said pump via a fluid connector and with a vial via a one-way valve, wherein fluid pressure in said intermediate chamber is greater than fluid pressure in said vial during pumping of contents out of said vial, and said fluid connector of said vial holder leads air into said intermediate chamber and said intermediate chamber does not contain any toxic material.

2. The fluid transfer device according to claim 1, further comprising a connector assembly for connection of said vial to a bag and syringe.

3. The fluid transfer device according to claim 1, further comprising a scale for weighing contents of said vial.

4. The fluid transfer device according to claim 1, further comprising an actuator for rotating said vial.

* * * * *